US008289225B2

(12) United States Patent
Shimizu et al.

(10) Patent No.: US 8,289,225 B2
(45) Date of Patent: Oct. 16, 2012

(54) MULTI-RESONANT ANTENNA HAVING DIELECTRIC BODY

(75) Inventors: Mie Shimizu, Kanagawa-ken (JP); Kazuhiko Kubota, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 37 days.

(21) Appl. No.: 12/838,050

(22) Filed: Jul. 16, 2010

(65) Prior Publication Data

US 2010/0277378 A1 Nov. 4, 2010

Related U.S. Application Data

(63) Continuation of application No. PCT/JP2009/050465, filed on Jan. 15, 2009.

(30) Foreign Application Priority Data

Jan. 17, 2008 (JP) ..... 2008-008193

(51) Int. Cl.
*H01Q 1/38* (2006.01)
*H01Q 1/24* (2006.01)

(52) U.S. Cl. ..... 343/895; 343/702

(58) Field of Classification Search ..... 343/700 MS, 343/702, 741–742, 846, 866–867, 873, 895, 343/700 M
See application file for complete search history.

(56) References Cited

U.S. PATENT DOCUMENTS 6,329,961 B1 * 12/2001 Mandai et al. ..... 343/873
7,057,576 B2 * 6/2006 Mukoyama ..... 343/895
7,161,555 B2 * 1/2007 Ohno et al. ..... 343/911 R
7,471,252 B2 * 12/2008 Onaka et al. ..... 343/702
7,538,732 B2 * 5/2009 Ishihara et al. ..... 343/702

(Continued)

FOREIGN PATENT DOCUMENTS

CN 1469412 A 1/2004

(Continued)

OTHER PUBLICATIONS

International Search Report; PCT/JP2009/050465; Apr. 28, 2009.

(Continued)

*Primary Examiner* — Michael C Wimer
(74) *Attorney, Agent, or Firm* — Studebaker & Brackett PC; Tim L. Brackett, Jr.; John E. Guay

(57) ABSTRACT

The antenna includes a power-feeding radiation electrode and a non-power-feeding radiation electrode are provided adjacent to each other with a gap therebetween on the flexible substrate, which also is bendable. The power-feeding radiation electrode is used to perform antenna operation in a basic mode in which resonant operation is performed at a basic frequency and antenna operation in a high-order mode in which resonant operation is performed at a frequency higher than the basic frequency. The power-feeding radiation electrode includes a loop path configured such that the power-feeding radiation electrode first extends in a direction away from a power-feeding end and an open end is bent toward the power-feeding end. The non-power-feeding radiation electrode has one end serving as a ground-side end and the other end serving as an open end. A dielectric body having permittivity higher than the bendable, flexible substrate is provided on a front surface or a back surface of the power-feeding radiation electrode provided in a region including a portion in which voltage of a resonant frequency in the high-order mode is zero potential and a region in the vicinity of that portion.

17 Claims, 9 Drawing Sheets

U.S. PATENT DOCUMENTS

| | | | | |
|---|---|---|---|---|
| 7,545,330 | B2 * | 6/2009 | Sakurai et al. | 343/700 MS |
| 7,911,387 | B2 * | 3/2011 | Hill et al. | 343/700 MS |
| 2003/0043071 | A1 * | 3/2003 | Lilly et al. | 342/368 |
| 2007/0188383 | A1 * | 8/2007 | Onaka et al. | 343/700 MS |

FOREIGN PATENT DOCUMENTS

| | | | |
|---|---|---|---|
| CN | 101099265 | A | 1/2008 |
| CN | 101106215 | A | 1/2008 |
| JP | 61-163706 | | 7/1986 |
| JP | 6-034309 | | 5/1994 |
| JP | 2003-078332 | A | 3/2003 |
| JP | 2003-158410 | A | 5/2003 |
| JP | 2005-130333 | A | 5/2005 |
| JP | 2005-184570 | A | 7/2005 |
| JP | 2006-080609 | A | 3/2006 |
| JP | 2006-157290 | A | 6/2006 |
| JP | 2007-006465 | A | 1/2007 |
| JP | 2007-067596 | A | 3/2007 |

OTHER PUBLICATIONS

Written Opinion of the International Searching Authority; PCT/JP2009/050465; Apr. 28, 2009.

The First Office Action issued by the State Intellectual Property Office of People's Republic of China on Jul. 2, 2012; Chinese Patent Application No. 200980102259.4 with translation.

* cited by examiner

FIG. 1D
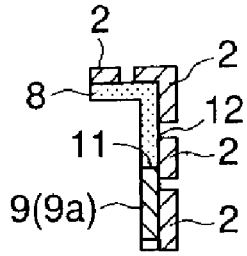
FIG. 1E
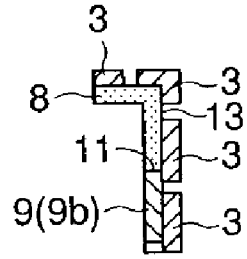
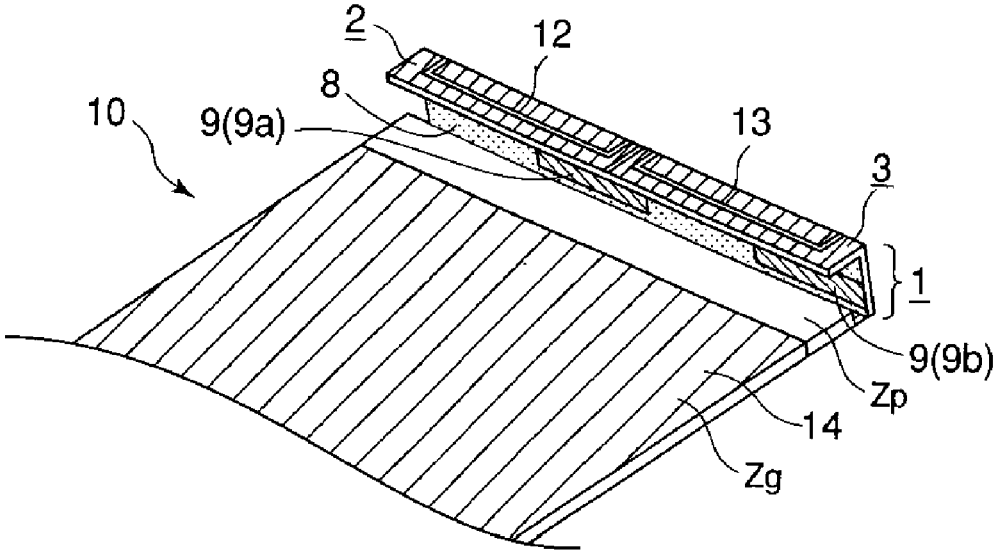
FIG. 2

FIG. 4C
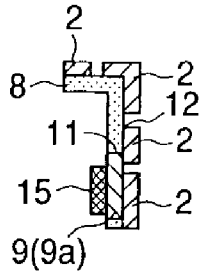
FIG. 4D
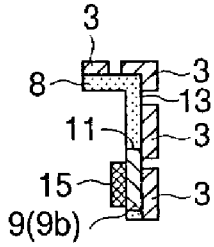
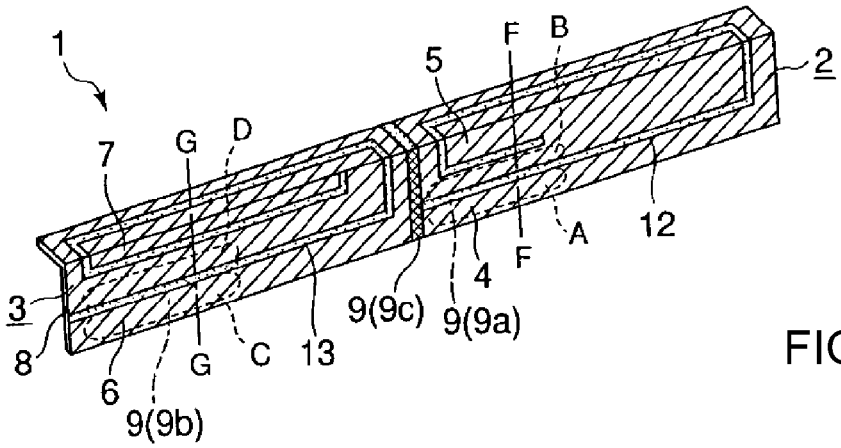
FIG. 5A
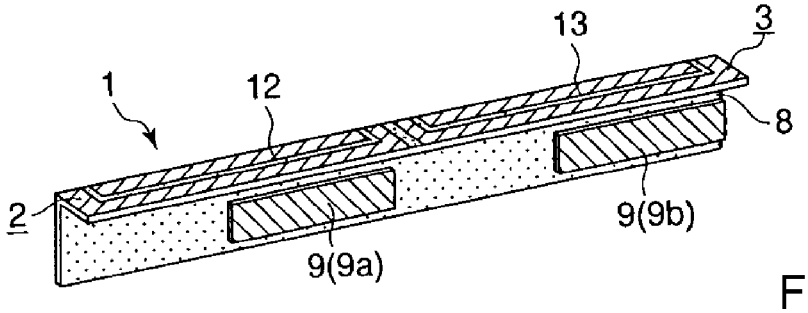
FIG. 5B

FIG. 5C
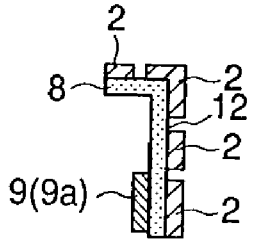
FIG. 5D
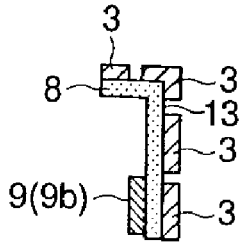
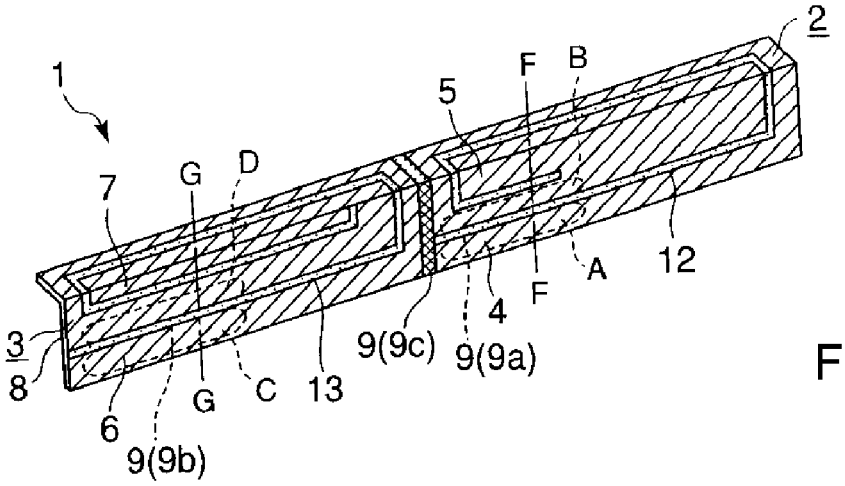
FIG. 6A
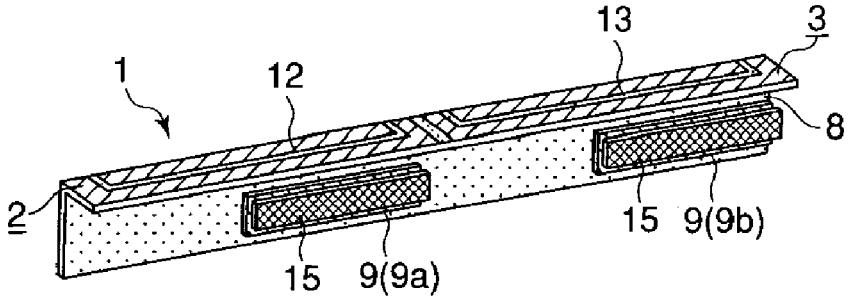
FIG. 6B

FIG. 6C
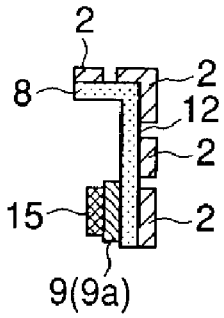
FIG. 6D
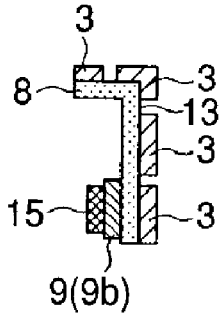
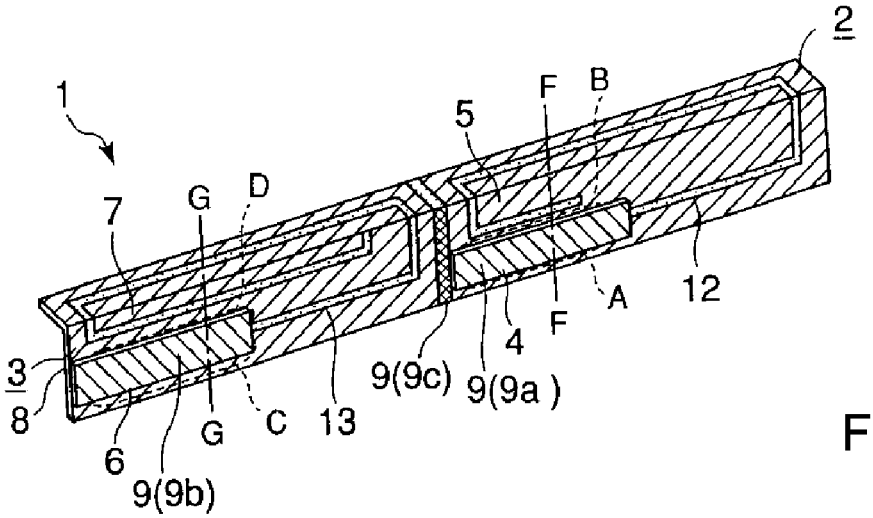
FIG. 7A
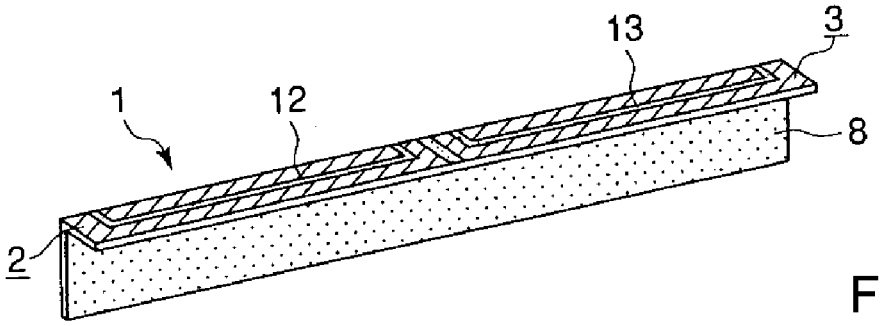
FIG. 7B

FIG. 7C
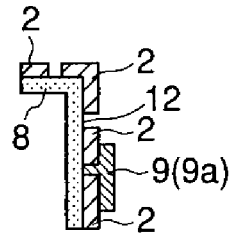
FIG. 7D
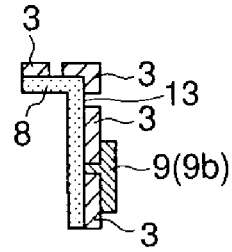
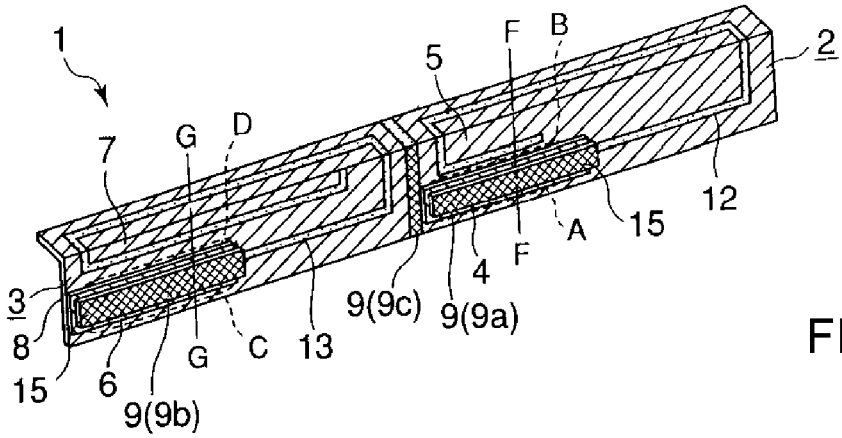
FIG. 8A
FIG. 8B
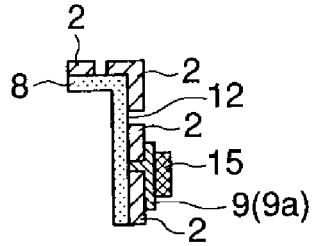
FIG. 8C
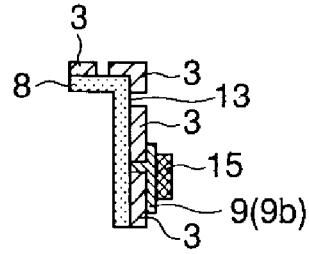

FIG. 10B
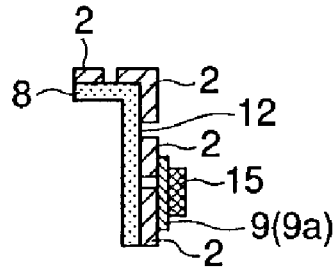
FIG. 10C
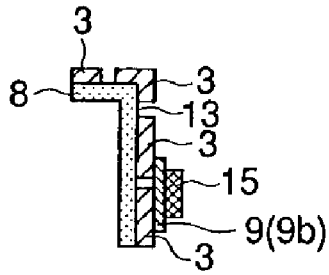
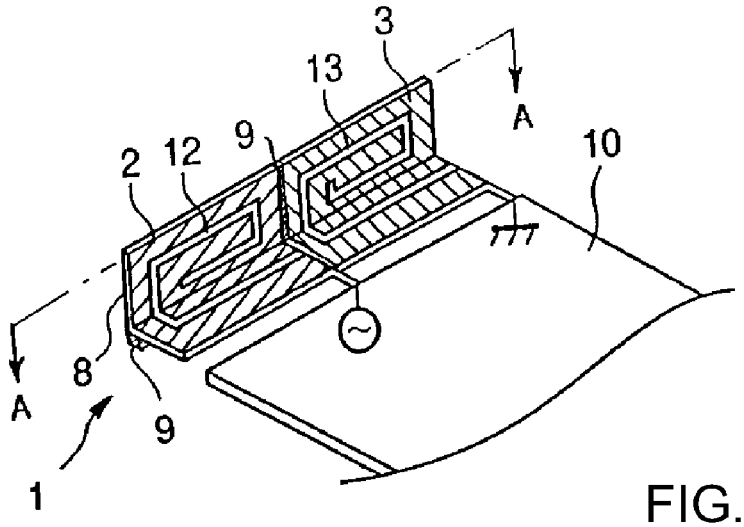
FIG. 11A
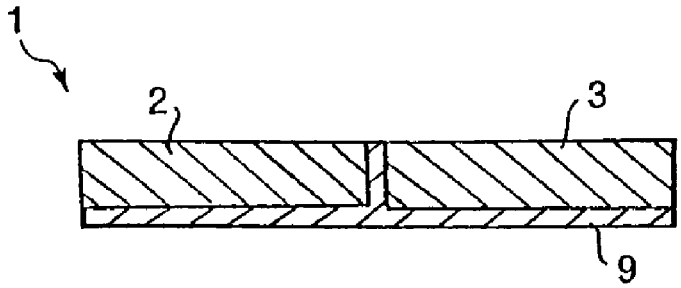
FIG. 11B

MULTI-RESONANT ANTENNA HAVING DIELECTRIC BODY

CROSS REFERENCE TO RELATED APPLICATION

The present application is a continuation of International Application No. PCT/JP2009/050465 filed Jan. 15, 2009, which claims priority to Japanese Patent Application No. 2008-008193 filed Jan. 17, 2008, the entire contents of each of these applications being incorporated herein by reference in their entirety.

TECHNICAL FIELD

The present invention relates to an antenna, for example, as antenna included in a wireless communication apparatus such as a portable telephone.

BACKGROUND

As antennas employed in wireless communication apparatuses such as portable telephones, different antennas having different configurations have been proposed. See, for example, Japanese Unexamined Patent Application Publication No. 2003-78332 ("Patent Document 1") and Japanese Unexamined Utility Model Application Publication No. 6-34309 ("Patent Document 2). For example, an antenna of the invention disclosed in Patent Document 1 includes a first resin which is not easily subjected to metal plating and a second resin which is easily subjected to metal plating. The antenna is formed by a two-step injection molding method so that at least part of the second resin is exposed. A conductive metal layer is plated on the second resin and a plated portion is configured as an element.

In recent years, especially there has been a demand for miniaturization of wireless communication apparatuses such as portable mobile terminals (portable telephones, for example) having wireless communication functions. Therefore, there has been a demand for miniaturization of antennas included in these portable mobile terminals. However, if antennas are miniaturized for this demand, according to the invention disclosed in Patent Document 1, there arises a problem in that radiation efficiency is deteriorated. This is because, in the invention disclosed in Patent Document 1, an element is formed on a resin by plating and the resin closely adheres to entire surfaces of a power-feeding element and a non-power-feeding element. Therefore, if the antenna is to be miniaturized, a resin having high permittivity is inserted between a radiation electrode and the ground. As a result, it is difficult to emit an electric field to the outside, and therefore, the radiation efficiency is deteriorated.

Furthermore, in the antenna according to the invention disclosed in Patent Document 1, for example, a line width and a length of a current path are adjusted in order to set a resonant frequency used for antenna operation to a desired frequency. Accordingly, if the antenna according to the invention disclosed in Patent Document 1 is miniaturized, a region in which the current path is to be formed is reduced, and therefore, an efficient line length is not ensured. Accordingly, the line width of the current path becomes small. In this case, there arises a problem in that conductive loss is increased due to concentrated current, and antenna efficiency is deteriorated.

SUMMARY

In an embodiment consistent with the claimed invention, an antenna includes a power-feeding radiation electrode having a power-feeding end and an open end. The power-feeding radiation electrode is configured to perform antenna operation in a basic mode in which resonant operation is performed in a basic frequency and antenna operation in a high-order mode in which resonant operation is performed in a frequency higher than the basic frequency. The antenna includes a non-power-feeding radiation electrode electromagnetically connected to the power-feeding radiation electrode. The non-power-feeding radiation electrode has one terminal serving as a ground-side end and another terminal serving as an open end. The power-feeding radiation electrode and the non-power-feeding radiation electrode are provided on a bendable, flexible substrate with a gap therebetween.

A dielectric body having permittivity higher than that of the bendable, flexible substrate is provided on a front surface or a back surface of the power-feeding radiation electrode in a region near the power-feeding end and a region including a portion in which voltage of a resonant frequency in the high-order mode is zero potential and a region in the vicinity of that portion.

The power-feeding radiation electrode includes a loop path configured such that the power-feeding radiation electrode first extends in a direction away from a power-feeding end and an open end is bent toward the power-feeding end, and the non-power-feeding radiation electrode has one terminal serving as a ground-side end and the other terminal serving as an open end.

According to a more specific exemplary embodiment, the non-power-feeding radiation electrode may include a loop path configured such that the non-power-feeding radiation electrode first extends in a direction away from the ground-side end and the open end is bent toward the ground-side end. Furthermore, a dielectric body having permittivity higher than that of the flexible substrate may be provided on a front surface or a back surface of the non-power-feeding radiation electrode in a region near the power-feeding end and a region including a portion in which voltage of a resonant frequency in the high-order mode is zero potential.

According to another more specific exemplary embodiment, the non-power-feeding radiation electrode may resonate in a frequency in the vicinity of at least one of a resonant frequency in a basic mode and a resonant frequency in a high-order mode so as to perform multi resonance with the power-feeding radiation electrode.

According to yet another more specific exemplary embodiment, a dielectric body having permittivity higher than that of the bendable, flexible substrate may be provided in a gap between the power-feeding radiation electrode and the non-power-feeding radiation electrode.

In yet another more specific exemplary embodiment, the antenna may be supported by, or mounted on a circuit substrate and is located near a ground region of the circuit substrate with a gap therebetween, and a dielectric body having permittivity higher than the bendable, flexible substrate may be provided on a region on a front surface or a back surface of at least one of the power-feeding radiation electrode and the non-power-feeding radiation electrode so as to be located at a region farthest from the ground region of the circuit substrate.

According to another more specific exemplary embodiment, through holes may be provided in the bendable, flexible substrate at portions where the dielectric bodies are to be provided, and then, the dielectric bodies may be provided in the through holes.

In another more specific exemplary embodiment, the dielectric bodies may be provided on front surfaces or back surfaces of the corresponding power-feeding radiation electrode and the corresponding non-power-feeding radiation electrode via the bendable, flexible substrate.

According to yet another more specific exemplary embodiment, each of the dielectric bodies may be provided directly on a front surface of a corresponding one of the power-feeding radiation electrode and the non-power-feeding radiation electrode.

In another more specific exemplary embodiment, the region near the power-feeding end and the region including the portion in which voltage of the resonant frequency in the high-order mode is zero potential and the region in the vicinity of the portion may be adjacent to each other with a gap therebetween, and a dielectric body may also be provided in the gap between these regions.

In yet another more specific exemplary embodiment, the region near the ground-side end and the region including the portion in which voltage of the resonant frequency in the high-order mode is zero potential and the region in the vicinity of the portion may be adjacent to each other with a gap therebetween, and a dielectric body may also be provided in the gap between the regions.

According to another more specific exemplary embodiment, each of the dielectric bodies may be provided on a certain portion of a corresponding one of the power-feeding radiation electrode and the non-power-feeding radiation electrode, and permittivity of the dielectric body provided on the power-feeding radiation electrode may be different from permittivity of the dielectric body provided on the non-power-feeding radiation electrode.

According to yet another more specific exemplary embodiment, each of the dielectric bodies may be formed of a dielectric sheet, a dielectric block, or dielectric paste, which is in a paste state at a temperature higher than normal temperature and becomes solidified at approximately 160° C.

According to another more specific exemplary embodiment, each of the electric bodies may be formed of resin having a relative permittivity of 6 or more.

In yet another more specific exemplary embodiment, each of the dielectric bodies may include a floating electrode on one side thereof, and one of the dielectric bodies may be sandwiched between the corresponding floating electrode and the power-feeding radiation electrode and the other one of the dielectric bodies may be sandwiched between the corresponding floating electrode and the non-power-feeding radiation electrode.

BRIEF DESCRIPTION OF DRAWINGS

FIG. 1D is a sectional view taken along a line F to F of FIG. 1A.

FIG. 1E is a sectional view taken along a line G to G of FIG. 1A.

FIG. 2 is a perspective view illustrating a state of an arrangement of the antenna of the first exemplary embodiment on a circuit substrate.

FIG. 4C is a sectional view taken along a line F to F of FIG. 4A.

FIG. 4D is a sectional view taken along a line G to G of FIG. 4A.

FIG. 5A is a perspective view illustrating an antenna according to a third exemplary embodiment.

FIG. 5B is a back view of FIG. 5A illustrating the antenna according to the third exemplary embodiment.

FIG. 5C is a sectional view taken along a line F to F of FIG. 5A.

FIG. 5D is a sectional view taken along a line G to G of FIG. 5A.

FIG. 6A is a perspective view illustrating an antenna according to a fourth exemplary embodiment.

FIG. 6B is a back view of FIG. 6A illustrating the antenna according to the fourth exemplary embodiment.

FIG. 6C is a sectional view taken along a line F to F of FIG. 6A.

FIG. 6D is a sectional view taken along a line G to G of FIG. 6A.

FIG. 7A is a perspective view illustrating an antenna according to a fifth exemplary embodiment.

FIG. 7B is a back view of FIG. 7A illustrating the antenna according to the fifth exemplary embodiment.

FIG. 7C is a sectional view taken along a line F to F of FIG. 7A.

FIG. 7D is a sectional view taken along a line G to G of FIG. 7A.

FIG. 8A is a perspective view illustrating an antenna according to a sixth exemplary embodiment.

FIG. 8B is a sectional view taken along a line F to F of FIG. 8A.

FIG. 8C is a sectional view taken along a line G to G of FIG. 8A.

FIG. 10B is a sectional view taken along a line F to F of FIG. 10A.

FIG. 10C is a sectional view taken along a line G to G of FIG. 10A.

FIG. 11A is a diagram illustrating an antenna and a circuit substrate according to another exemplary embodiment.

FIG. 11B is a sectional view taken along a line A to A of the antenna shown in FIG. 11A.

DETAILED DESCRIPTION

Embodiments of the present invention will be described hereinafter with reference to the accompanying drawings.

Figure 1A:
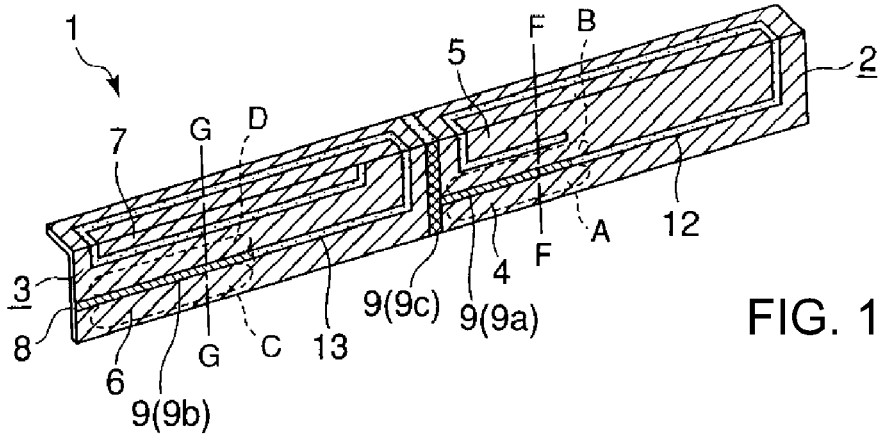
FIG. 1A is a perspective view illustrating an antenna according to a first exemplary embodiment.
Figure 1B:
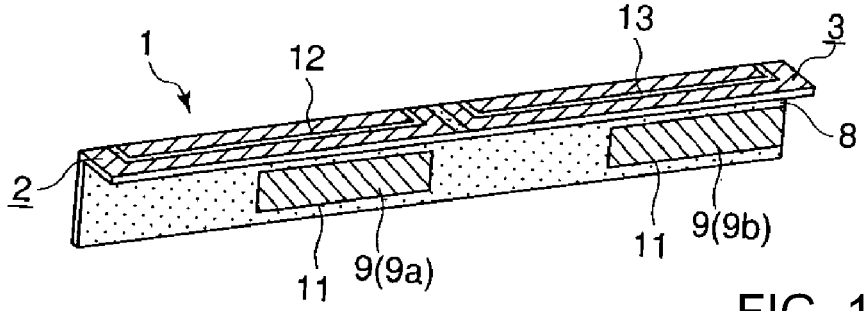
FIG. 1B is a back view illustrating the antenna according to the first exemplary embodiment.
Figure 1C:
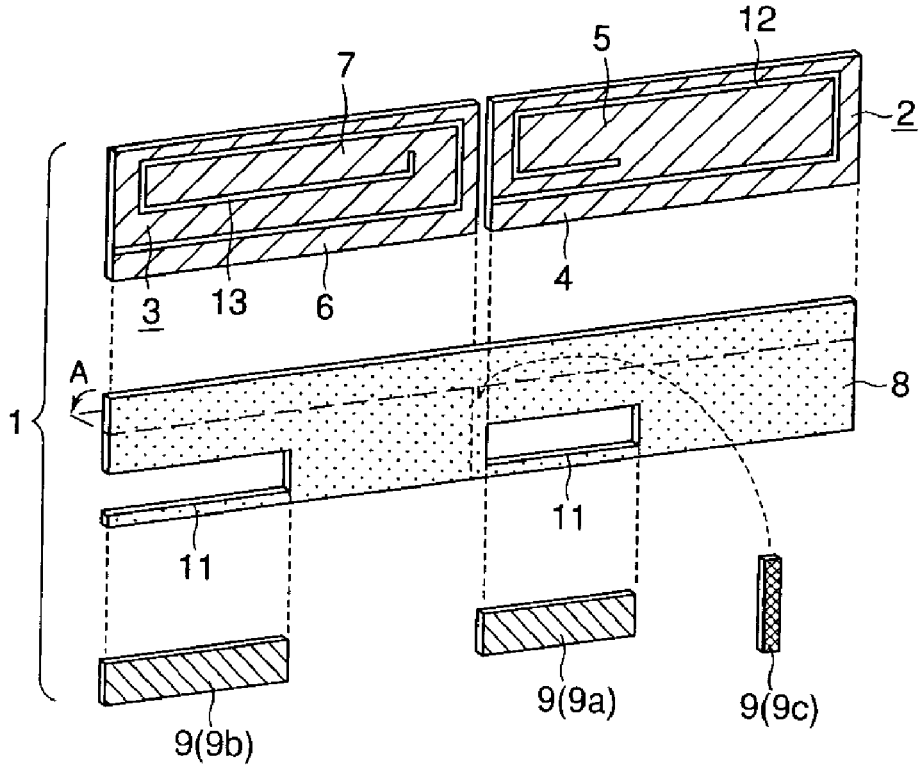
FIG. 1C is an exploded view illustrating the antenna according to the first exemplary embodiment.

FIG. 1A is a perspective view schematically illustrating an antenna according to a first exemplary embodiment. FIG. 1B is a back view schematically illustrating the antenna shown in FIG. 1A. FIG. 1C is an exploded view schematically illustrating the antenna shown in FIG. 1A. FIG. 1*d* is a sectional view taken along a line F to F of FIG. 1A. FIG. 1E is a sectional view taken along a line G to G of FIG. 1A.

This antenna 1 is disposed, or provided on one end of a circuit substrate 10 of a wireless communication apparatus such as a portable phone as shown in FIG. 2, for example, and is electrically connected to the circuit substrate 10. Note that the circuit substrate 10 includes a ground region Zg having a ground electrode 14 disposed, or provided thereon and a non-ground region Zp which does not include the ground electrode 14. In the circuit substrate 10 shown in FIG. 2, the non-ground region Zp is formed on the one end of the circuit substrate 10. The antenna 1 according to this embodiment is provided near the non-ground region Zp with a gap therebetween. The circuit substrate 10 includes a wireless communication circuit (high frequency circuit).

The antenna 1 of this embodiment includes a flexible substrate 8 as shown in FIG. 1C. The flexible substrate 8 has flexibility, and therefore, the flexible substrate 8 can be bent in accordance with an arrow A so as to change a state thereof from a state shown in FIG. 1C to a state shown in FIG. 1A. The flexible substrate 8 is formed of polyimide resin such as Kapton™, polyethylene terephthalate, or very thin resin (approximately 100 μm, for example) such as FR4 (glass epoxy), for example. The flexible substrate 8 includes two through holes 11.

The antenna 1 is configured such that a power-feeding radiation electrode 2 and a non-power-feeding radiation electrode 3 are provided on a front surface of the flexible substrate 8 so as to be adjacent to each other with a gap therebetween. The electrodes 2 and 3 are formed of copper and have thin plate shapes. Furthermore, the power-feeding radiation electrode 2 and the non-power-feeding radiation electrode 3 can be bent along with the flexible substrate 8 so as to change states thereof from states shown in FIG. 1C to states shown in FIG. 1A.

The power-feeding radiation electrode 2 is used to perform antenna operation in a basic mode (basic resonance mode) in which resonant operation is performed in a basic frequency, and antenna operation in a high-order mode (high-order resonance mode) in which resonant operation is performed at a frequency higher than the basic frequency. The non-power-feeding radiation electrode 3 is electromagnetically coupled to the power-feeding radiation electrode 2. Furthermore, the non-power-feeding radiation electrode 3 resonates in a frequency at least in the vicinity of the resonant frequency in the basic mode of the power-feeding radiation electrode 2 or the resonant frequency in the high-order mode, and performs multi resonance with the power-feeding radiation electrode 2.

The power-feeding radiation electrode 2 includes a slit 12. One end of the power-feeding radiation electrode 2 serves as a power-feeding end 4 connected to a power-feeding portion (not shown) of the circuit substrate 10 shown in FIG. 2, and the other end serves as an open end 5. The power-feeding radiation electrode 2 includes a loop path configured such that the power-feeding radiation electrode 2 first extends to a direction away from the power-feeding end 4 and the open end 5 is bent toward the power-feeding end 4. Similarly, the non-power-feeding radiation electrode 3 includes a slit 13. One end of the non-power-feeding radiation electrode 3 serves as a ground-side end 6 connected to the non-ground region Zp of the circuit substrate 10, and the other end serves as an open end 7. The non-power-feeding radiation electrode 3 has a loop path configured such that the non-power-feeding radiation electrode 3 first extends toward a direction away from the ground-side end 6 and the open end 7 is bent toward the ground-side end 6.

A feature of the configuration of this embodiment is that dielectric bodies 9 (9A and 9B) have a permittivity higher than the flexible substrate 8 and are disposed, or provided as follows: the dielectric body 9A is disposed, or provided only on a region A and a region B of the power-feeding end 4, the region B including a portion in which voltage of a resonant frequency in the high-order mode is zero potential and a region in the vicinity of the portion; and the dielectric body 9B is disposed, or provided only on a region C and a region D of the ground-side end 6, the region D including a portion in which voltage of a resonant frequency in the high-order mode is zero potential and a region in the vicinity of that portion.

Each of the dielectric bodies 9A and 9B can be formed of a dielectric sheet or a dielectric block, such as PVDF (polyvinylidene-fluoride) having a relative permittivity of 6 or more. The dielectric bodies 9A and 9B are disposed, or provided in the through holes 11 included in the flexible substrate 8. In other words, as shown in FIGS. 1D and 1E, the through holes 11 are formed at portions of the flexible substrate 8 in which the dielectric bodies 9 (9A and 9B) are to be disposed, or provided, and then, the dielectric bodies 9A and 9B are provided in the through holes 11. The dielectric bodies 9A and 9B may be formed by the same dielectric bodies or different dielectric bodies. Detailed configurations of the dielectric bodies 9A and 9B can be determined taking electronic components, for example, arranged near a portion where the antenna 1 is provided, into consideration.

Figure 3:
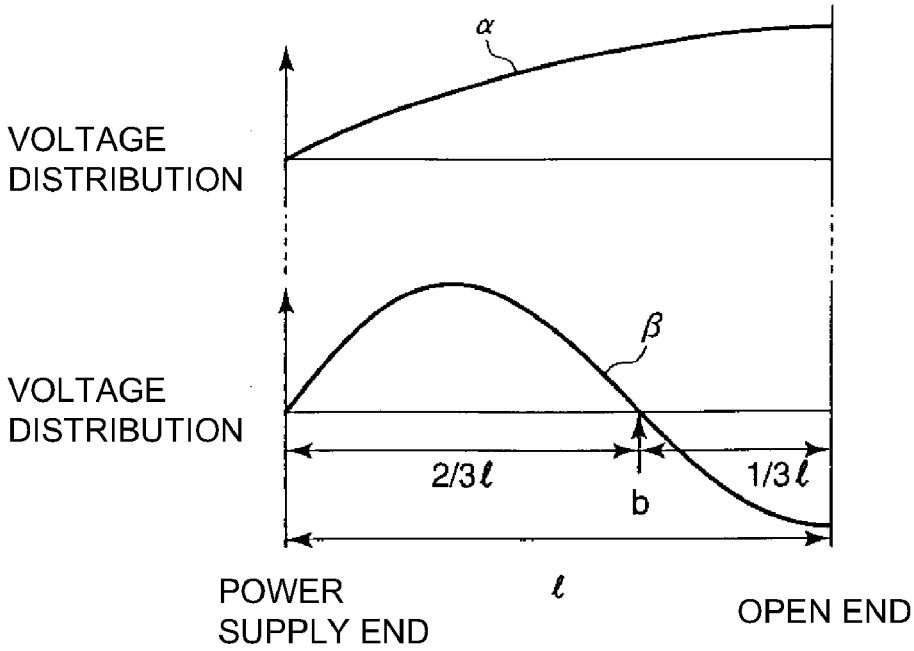
FIG. 3 is a graph illustrating voltage distribution of a power-feeding radiation electrode of the antenna according to the first exemplary embodiment.

Note that voltage distribution in the basic mode (basic resonance mode) of the power-feeding radiation electrode 2 is shown using a solid line α in FIG. 3. Furthermore, voltage distribution in the high-order mode (high-order resonance mode) of the power-feeding radiation electrode 2 is shown using a solid line β in FIG. 3. In this embodiment, the antenna operation in the high-order mode performed by the power-feeding radiation electrode 2 corresponds to the antenna operation in a third-order mode. Voltage of a resonant frequency of the third-order mode corresponds to zero potential at a portion of two third of a length between the power-feeding end 4 to the open end 5 (refer to a point "b" of FIG. 3). This portion and a portion (around the point "b") in the vicinity of the portion are included in the region B. In this embodiment, the power-feeding radiation electrode 2 has a loop shape as described above, and as shown in FIG. 1A, the region A of the power-feeding end 4 of the power-feeding radiation electrode 2 and the region B including the portion in which the voltage of the resonant frequency in the high-order mode is zero potential and a region in the vicinity of the portion are disposed, or provided adjacent to each other with a gap therebetween. The dielectric body 9A is disposed, or provided so as to stride over the gap between the regions A and B.

Furthermore, voltage distribution in the basic mode and the high-order mode of the non-power-feeding radiation electrode 3 is substantially the same as that of the power-feeding radiation electrode 2. In the non-power-feeding radiation electrode 3, the region D including the portion in which the voltage of the resonant frequency in the high-order mode is zero potential and a region in the vicinity of the portion includes a point at two thirds of a length between the ground-side end 6 to the open end 7. In this embodiment, the non-power-feeding radiation electrode 3 has a loop shape as described above, and the region C of the ground-side end 6 of the non-power-feeding radiation electrode 3 and the region D including the portion in which the voltage of the resonant frequency in the high-order mode is zero potential and a region in the vicinity of that portion are provided adjacent to each other with a gap therebetween. The dielectric body 9B is provided so as to stride over the gap between the regions C and D.

Furthermore, in this embodiment, another dielectric body 9 (9C) having permittivity higher than the flexible substrate 8 is disposed, or provided in the gap formed between the power-feeding radiation electrode 2 and the non-power-feeding radiation electrode 3. The dielectric body 9C is formed of a dielectric block, for example, and extends from one end (near the circuit substrate 10) of the flexible substrate 8 to an end portion of a bending portion of the flexible substrate 8.

The antenna 1 of the first exemplary embodiment is configured as described above. That is, the dielectric bodies 9A and 9B are provided on the portions of the power-feeding radiation electrode 2 and the non-power-feeding radiation electrode 3 of the antenna 1, and the dielectric body 9C is provided in the gap between the electrodes 2 and 3. With this configuration of the first embodiment, with the antenna 1 miniaturized, deterioration of the radiation efficiency and increase of conductive loss can be prevented, and a resonant frequency used for the antenna operation is set to a desired frequency, resulting in achievement of an antenna which realizes high performance.

Figure 4A:
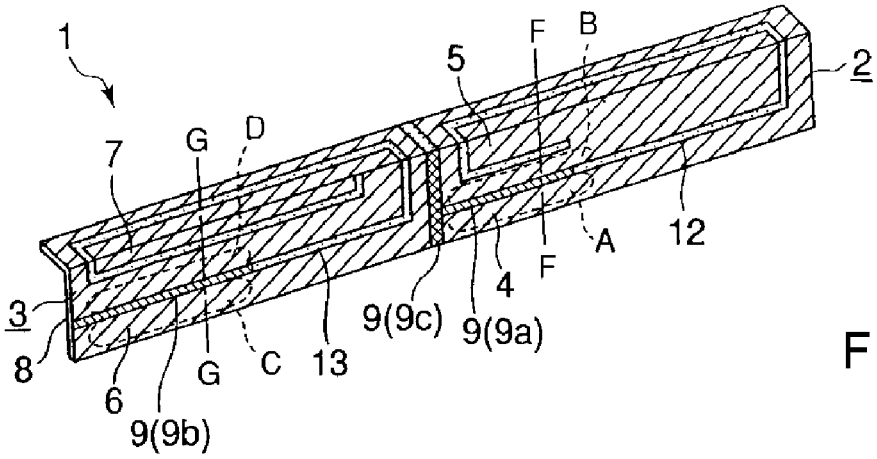
FIG. 4A is a perspective view illustrating an antenna according to a second exemplary embodiment.
Figure 4B:
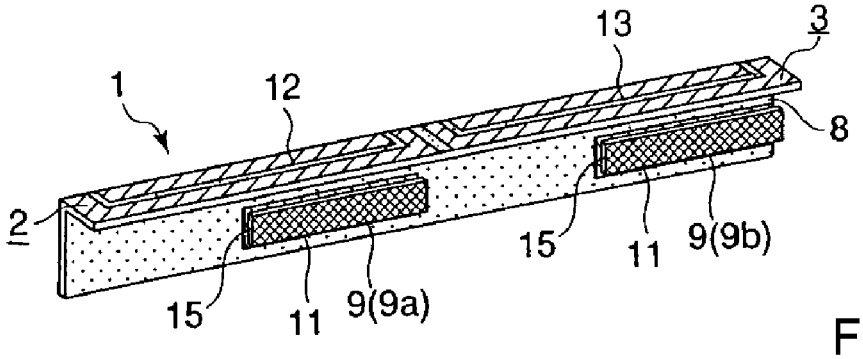
FIG. 4B is a back view of FIG. 4A illustrating the antenna according to the second exemplary embodiment.

FIG. 4A is a perspective view schematically illustrating an antenna 1 according to a second exemplary embodiment. FIG. 4B is a back view of the antenna 1 shown FIG. 4A schematically illustrating the antenna. FIG. 4C is a sectional view taken along a line F to F of FIG. 4A. FIG. 4D is a sectional view taken along a line G to G of FIG. 4A.

Note that, in the second exemplary embodiment and the following exemplary embodiments, components the same as those described in the first embodiment are denoted by reference numerals the same as those used in the first exemplary embodiment, and descriptions thereof are provided above and/or are briefly made.

The antenna 1 of the second exemplary embodiment is configured similarly to that of the first exemplary embodiment. The antenna 1 of the second exemplary embodiment is different from that of the first exemplary embodiment in that floating electrodes 15 are provided on one side (a back side in this embodiment) of a dielectric body 9A and one side (a back side in this embodiment) of a dielectric body 9B. The floating electrodes 15 are formed of metal, such as copper. The dielectric body 9A is sandwiched between one of the floating electrodes 15 and the power-feeding radiation electrode 2. Similarly, the dielectric body 9B is sandwiched between the other of the floating electrodes 15 and the non-power-feeding radiation electrode 3. In the second exemplary embodiment, presence of the floating electrodes 15 facilitates control of permittivity.

FIG. 5A is a perspective view schematically illustrating an antenna 1 according to a third exemplary embodiment. FIG. 5B is a back view of the antenna 1 shown in FIG. 5A schematically illustrating the antenna 1. FIG. 5C is a sectional view taken along a line F to F of FIG. 5A. FIG. 5D is a sectional view taken along a line G to G of FIG. 5A.

The antenna 1 of the third exemplary embodiment is configured similarly to those of the first and second exemplary embodiments. The antenna 1 of the third exemplary embodiment is different from those of the first and second exemplary embodiments in that dielectric bodies 9A and 9B are provided on back surfaces of a power-feeding radiation electrode 2 and a non-power-feeding radiation electrode 3 through a flexible substrate 8. That is, in the third exemplary embodiment, unlike the first exemplary embodiment, the flexible substrate 8 does not include through holes 11, and the dielectric bodies 9A and 9B are provided on a back surface of the flexible substrate 8. Accordingly, as shown in FIG. 5A, when the antenna 1 is viewed from a front side thereof, the dielectric bodies 9A and 9B are hidden. In the third exemplary embodiment, a step of forming the through holes 11 on the flexible substrate 8 can be eliminated.

FIG. 6A is a perspective view schematically illustrating an antenna 1 according to a fourth exemplary embodiment. FIG. 6B is a back view of the antenna 1 shown in FIG. 6A schematically illustrating the antenna 1. FIG. 6C is a sectional view taken along a line F to F of FIG. 6A. FIG. 6D is a sectional view taken along a line G to G of FIG. 6A.

The antenna 1 of the fourth exemplary embodiment is configured similarly to those of the third exemplary embodiment. The antenna 1 of the fourth exemplary embodiment is different from that of the third exemplary embodiment in that floating electrodes 15 are provided on one side (a back side in this embodiment) of a dielectric body 9A and one side (a back side in this embodiment) of a dielectric body 9B. The dielectric body 9A is sandwiched between one of the floating electrodes 15 and a power-feeding radiation electrode 2. Similarly, the dielectric body 9B is sandwiched between the other of the floating electrodes 15 and a non-power-feeding radiation electrode 3.

FIG. 7A is a perspective view schematically illustrating an antenna 1 according to a fifth exemplary embodiment. FIG. 7B is a back view of the antenna 1 shown FIG. 7A schematically illustrating the antenna 1. FIG. 7C is a sectional view taken along a line F to F of FIG. 7A. FIG. 7D is a sectional view taken along a line G to G of FIG. 7A.

The antenna 1 of the fifth exemplary embodiment is configured similarly to those of the first to fourth exemplary embodiments. The antenna 1 of the fifth exemplary embodiment is different from those of the first to fourth exemplary embodiments in that dielectric bodies 9A and 9B are provided directly on front surfaces of a power-feeding radiation electrode 2 and a non-power-feeding radiation electrode 3. The antenna 1 of the fifth exemplary embodiment is further different from those of the first to fourth exemplary embodiments in that the dielectric body 9A is provided in a gap between regions A and B, and the dielectric body 9B is provided in a gap between regions C and D.

The dielectric bodies 9A and 9B are formed of dielectric paste which is in a paste state over a temperature higher than normal temperature and becomes solidified at approximately 160° C. Note that the dielectric paste can be solidified by thermal hardening while a flexible substrate 8 is not deformed due to contraction. Since the dielectric bodies 9A and 9B formed of such dielectric paste are employed, the dielectric bodies 9A and 9B can be appropriately provided in the gap between the regions A and B and the gap between the regions C and D with ease, resulting in improvement of productivity.

Furthermore, when a dielectric body 9C is similarly formed of the dielectric paste, the following preferable effect is attained. That is, since the dielectric body 9C has flexibility before being solidified, even if an entire region of a gap between the power-feeding radiation electrode 2 and the non-power-feeding radiation electrode 3 is filled with the dielectric body 9C, the dielectric body 9C can be bent along with the flexible substrate 8 at a desired angle. Thereafter, the dielectric paste can be solidified, and accordingly, a desired shape of the antenna can be kept.

FIG. 8A is a perspective view schematically illustrating an antenna 1 according to a sixth exemplary embodiment. FIG. 8B is a sectional view taken along a line F to F of FIG. 8A. FIG. 8C is a sectional view taken along a line G to G of FIG. 8A.

The antenna 1 of the sixth exemplary embodiment is configured similarly to the fifth exemplary embodiment. The antenna 1 of the sixth embodiment is different from that of the fifth embodiment in that floating electrodes 15 are provided on one side (a front side) of a dielectric body 9A and one side (a front side) of a dielectric body 9B. The dielectric body 9A is sandwiched between one of the floating electrodes 15 and the power-feeding radiation electrode 2. Similarly, the dielectric body 9B is sandwiched between the other of the floating electrodes 15 and the non-power-feeding radiation electrode 3. Note that the diagram of the back view of the antenna 1 according to the fifth exemplary embodiment is applicable to the antenna 1 of the sixth exemplary embodiment (refer to FIG. 7B).

Figure 9A:
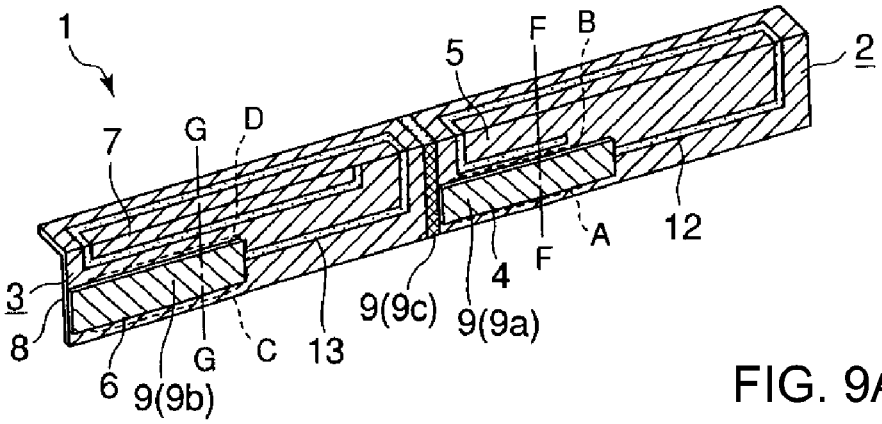
FIG. 9A is a perspective view illustrating an antenna according to a seventh exemplary embodiment.
Figure 9B:
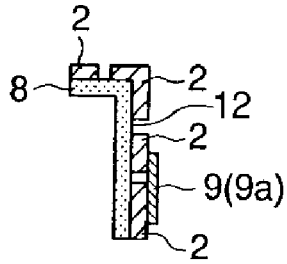
FIG. 9B is a sectional view taken along a line F to F of FIG. 9A.
Figure 9C:
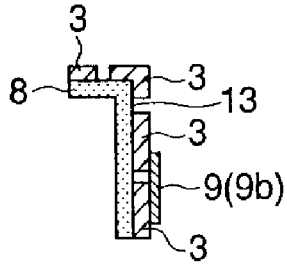
FIG. 9C is a sectional view taken along a line G to G of FIG. 9A.

FIG. 9A is a perspective view schematically illustrating an antenna 1 according to a seventh exemplary embodiment. FIG. 9B is a sectional view taken along a line F to F of FIG. 9A. FIG. 9C is a sectional view taken along a line G to G of FIG. 9A.

The antenna 1 of the seventh exemplary embodiment is configured similarly to the fifth exemplary embodiment. The antenna 1 of the seventh exemplary embodiment is different from that of the fifth exemplary embodiment in that each of dielectric bodies 9A and 9B are formed of a dielectric block or a dielectric sheet. The antenna 1 of the seventh exemplary embodiment is further different from that of the fifth exemplary embodiment in that the dielectric body 9A is not included in the gap between the regions A and B and the dielectric body 9B is not included in the gap between the regions C and D.

Figure 10A:
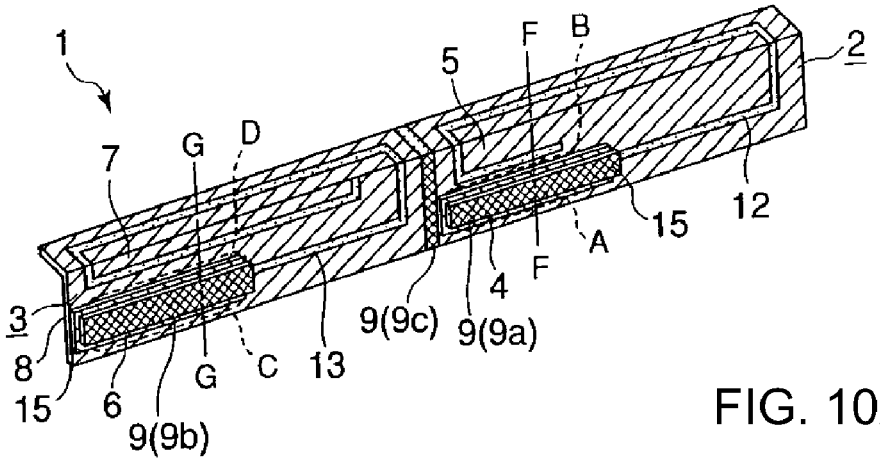
FIG. 10A is a perspective view illustrating an antenna according to an eighth exemplary embodiment.

FIG. 10A is a perspective view schematically illustrating an antenna 1 according to an eighth exemplary embodiment. FIG. 10B is a sectional view taken along a line F to F of FIG. 10A. FIG. 10C is a sectional view taken along a line G to G of FIG. 10A.

The antenna 1 of the eighth embodiment is configured similarly to the seventh exemplary embodiment. The antenna 1 of the eighth exemplary embodiment is different from that of the seventh exemplary embodiment in that floating electrodes 15 are provided on one side (front side in this embodiment) of a dielectric body 9A and one side (front side in this embodiment) of a dielectric body 9B. The dielectric body 9A is sandwiched between one of the floating electrodes 15 and the power-feeding radiation electrode 2. Similarly, the dielectric body 9B is sandwiched between the other of the floating electrodes 15 and the non-power-feeding radiation electrode 3.

Note that embodiments consistent with the claimed invention are not limited to the foregoing exemplary embodiments and various modifications can be made. For example, in the foregoing exemplary embodiments, the power-feeding radiation electrode 2 and the non-power-feeding radiation electrode 3 are formed in thin plate shapes by plating. However, the power-feeding radiation electrode 2 and the non-power-feeding radiation electrode 3 can be formed on the flexible substrate 8 by an appropriate method such as spattering or coating. Further, in the above embodiments, the power-feeding radiation electrode 2 and the non-power-feeding radiation electrode 3 are preferably disposed, or provided on the front surface of the flexible substrate 8. However, the power-feeding radiation electrode 2 and the non-power-feeding radiation electrode 3 can be embedded in the flexible substrate 8.

Moreover, even with the dielectric bodies 9 (9A and 9B) provided on the back surface of the flexible substrate 8, the dielectric bodies 9A and 9B can be formed by the dielectric paste which is solidified at normal temperature or low temperature. Furthermore, the dielectric body 9C may be appropriately formed of a dielectric sheet, a dielectric block, or dielectric paste which is in a paste state at temperature higher than normal temperature and which is solidified at low temperature, i.e., approximately 160° C.

Furthermore, the bending angle of the flexible substrate 8 is not limited to a right angle or a substantially right angle of the foregoing embodiments. The bending angle of the flexible substrate 8 can be appropriately determined depending on a wireless communication apparatus in which it is provided, such as a portable telephone including the antenna 1. Moreover, the antenna 1 can be disposed, or provided without bending the flexible substrate 8 if a height of a region in which the antenna 1 of the wireless communication apparatus is to be provided is sufficiently large, such that the flexible substrate 8 can be provided therein without being bent. That is, with an antenna according to the claimed invention, since the flexible substrate 8 is employed, the flexible substrate 8, the power-feeding radiation electrode 2, and the non-power-feeding radiation electrode 3 can be appropriately bent with ease so that the antenna can be provided in various states. Therefore, embodiments of the claimed antenna can be applicable to various wireless communication apparatuses, can be easily manufactured, and attains reduction of cost.

In addition, an antenna 1 consistent with the claimed invention can be formed as another exemplary embodiment shown in FIG. 11A. The antenna 1 shown in FIG. 11A is disposed, or provided such that the antenna 1 is supported by, or mounted on a circuit substrate 10, and is located near a ground region of the circuit substrate 10 with a gap therebetween. A dielectric body 9 is provided on a region on a front surface or a back surface (a back surface in FIG. 11A) of at least one of a power-feeding radiation electrode 2 and a non-power-feeding radiation electrode 3 so as to be located at a region farthest from the ground region of the circuit substrate 10. The region located farthest from the ground region corresponds to a bending portion of a flexible substrate 8 in FIG. 11A. The dielectric body 9 provided on this portion has permittivity higher than the flexible substrate 8. Furthermore, in the example shown in FIG. 11A, another dielectric body 9 is provided in a gap between the power-feeding radiation electrode 2 and the non-power-feeding radiation electrode 3. Note that FIG. 11B is a sectional view taken along a line A to A of the antenna 1 shown in FIG. 11A. In FIG. 11B, slits 12 and 13 of the power-feeding radiation electrode 2 and the non-power-feeding radiation electrode 3 are omitted, and arrangement of a dielectric body 9 is schematically shown.

Furthermore, in the foregoing exemplary embodiments, the non-power-feeding radiation electrode 3 resonates in a frequency in the vicinity of at least a resonant frequency in the basic mode of the power-feeding radiation electrode 2 or a resonant frequency in the high-order mode, and performs multi resonance with the power-feeding radiation electrode 2. However, the non-power-feeding radiation electrode 3 may resonant separately from a resonant frequency of the power-feeding radiation electrode 2.

Furthermore, in the foregoing exemplary embodiments, the dielectric body 9A of the power-feeding radiation electrode 2 and the dielectric body 9B of the non-power-feeding radiation electrode 3 are provided on the same side. However, the dielectric bodies 9A and 9B may be provided such that the dielectric body 9A is provided on the front surface of the power-feeding radiation electrode 2 and the dielectric body 9B is provided on the back surface of the non-power-feeding radiation electrode 3, or vice versa, for example.

Moreover, the dielectric body 9B may be provided on an entire surface of the non-power-feeding radiation electrode 3. Note that when a region which does not include the dielectric bodies 9 is provided at a portion of the electrodes 2 and 3 instead of providing the dielectric bodies 9 on entire surfaces of the electrodes 2 and 3, radiation efficiency is prevented from being deteriorated and weight thereof can be reduced when compared with a case where the dielectric bodies 9 are provided on the entire surfaces.

In addition, in the foregoing exemplary embodiments, the antenna 1 is provided adjacent to the non-ground region Zp with a gap therebetween. However, the antenna 1 may be provided on the non-ground region Zp. Furthermore, the antenna 1 may be provided on the ground region Zg.

In an embodiment of an antenna consistent with the claimed invention, a power-feeding radiation electrode is used to perform antenna operation in a basic mode in which resonant operation is performed in a basic frequency and antenna operation in a high-order mode in which resonant operation is performed in a frequency higher than the basic frequency, and a non-power-feeding radiation electrode electromagnetically connected to the power-feeding radiation electrode are provided on a flexible substrate, which is bendable, with a gap therebetween. With this configuration, a degree of freedom of arrangement in wireless communication apparatuses such as portable telephones can be enhanced. For example, the antenna of the present invention may be fixedly provided along an inner portion of a case of a wireless communication apparatus. Therefore, even when an antenna is miniaturized, excellent antenna characteristics can be attained.

Furthermore, in an antenna according to the claimed invention, since at least the power-feeding radiation electrode has a loop path, a large electric length can be attained, and therefore, a resonant frequency in the basic mode can be controlled to an appropriate value.

Further, embodiments consistent with the claimed invention include a dielectric body having permittivity higher than that of the flexible substrate on a front surface or a back surface of the power-feeding radiation electrode in a region near the power-feeding end and a region including a portion in which voltage of a resonant frequency in the high-order mode is zero potential and a region in the vicinity of the portion. Accordingly, the present invention attains the following advantages.

The antenna can be normally mounted on the circuit substrate or supported by the circuit substrate so as to be provided in the vicinity of the circuit substrate, and therefore, the antenna can be provided near the ground electrode, which is an essential element of the circuit substrate. Accordingly, in the antenna, if a dielectric body is provided on an entire surface of the power-feeding radiation electrode, an electric field can be attracted on a ground region side. However, if the dielectric body is partly provided as described above, when compared with the case where the dielectric body is provided on the entire surface of the electrode, a degree of the attraction of the electric field toward the ground region side (degree of coupling with the ground) can be reduced. Accordingly, since a capacitance with the ground can be obtained in the present invention, a low Q value can be attained and antenna efficiency can be improved. Furthermore, since a region of the dielectric body can be reduced according to the present invention when compared with the case where the dielectric body is provided on the entire surface of the electrode, weight of the antenna can be reduced.

Moreover, since a dielectric body is provided on a region near the power-feeding end of the power-feeding radiation electrode, a capacitance can be obtained between the power-feeding end and the open end of the power-feeding radiation electrode having a loop shape. Accordingly, in the present invention, a low resonant frequency can be attained in the high-order mode. Note that the resonant frequency in the basic mode of the antenna is determined in accordance with the electric length of the power-feeding radiation electrode. However, since it is possible that the resonant frequency in the basic mode may be shifted due to presence of electric components provided on the circuit substrate, a degree of the shift should be controlled. On the other hand, only the resonant frequency in the basic mode can be controlled to be low by disposing the dielectric body in a region including a portion in which voltage of the resonant frequency in the high-order mode is zero potential and a region in the vicinity of the portion. That is, since the arrangement position of the dielectric body is determined as described above, only the resonant frequency in the basic mode can be controlled to be low without shifting the resonant frequency in the high-order mode (that is, without shifting the resonant frequency in the high-order mode which has been shifted by the dielectric body provided on the region near the power-feeding end). Furthermore, unlike a case where a line width or a line length of a current path is controlled, increase of conductive loss can be prevented.

As described above, with embodiments of an antenna consistent with the claimed invention, even when the antenna is miniaturized, deterioration of radiation efficiency and increase of conductive loss can be reduced, and a desired resonant frequency used for antenna operation can be attained.

In embodiments utilizing a non-power-feeding radiation electrode including a loop path configured such that the non-power-feeding radiation electrode first extends in a direction away from the ground-side end and the open end is bent toward the ground-side end, and a dielectric body having permittivity higher than that of the flexible substrate provided on a front surface or a back surface of the non-power-feeding radiation electrode in a region near the power-feeding end and a region including a portion in which voltage of a resonant frequency in the high-order mode is zero potential, advantages the same as those attained on the power-feeding radiation electrode side can be attained on the non-power-feeding radiation electrode side.

Additionally, in embodiments in which the non-power-feeding radiation electrode resonates in a frequency in the vicinity of at least one of a resonant frequency in a basic mode and a resonant frequency in a high-order mode so as to perform multi resonance with the power-feeding radiation electrode, antenna operation can be performed in frequencies in a wide band using the multi resonance.

Also, in embodiments in which a dielectric body having permittivity higher than that of the bendable, flexible substrate is provided in a gap between the power-feeding radiation electrode and the non-power-feeding radiation electrode, the correlative relationship between the resonant frequency of the power-feeding radiation electrode and the resonant frequency of the non-power-feeding radiation electrode can be controlled in the basic mode and the high-order mode. In addition, the power-feeding radiation electrode and the non-power-feeding radiation electrode can be controlled to perform multi resonance or to independently resonant with ease.

Additionally, in embodiments in which the antenna is supported by, or mounted on a circuit substrate and is located near a ground region of the circuit substrate with a gap therebetween, and a dielectric body having permittivity higher than the bendable, flexible substrate is provided on a region on a front surface or a back surface of at least one of the power-feeding radiation electrode and the non-power-feeding radiation electrode so as to be located at a region farthest from the ground region of the circuit substrate, when compared with a case where the dielectric body is provided near a ground region, a degree of attraction of an electric field toward the ground region can be reduced. Accordingly, advantages to be attained by arrangement of the dielectric body can be expected while a degree of coupling with the ground region is prevented.

Additionally, in embodiments having the dielectric bodies directly provided on a front surface of a corresponding one of the power-feeding radiation electrode and the non-power-feeding radiation electrode, the frequency control effect described above can be easily attained. Especially, if the dielectric bodies are provided in through holes formed in the position of the bendable, flexible substrate where the dielectric bodies are to be provided, or if the dielectric bodies are provided directly on the front surfaces of the power-feeding radiation electrode and the non-power-feeding radiation electrode, the dielectric bodies contact to the power-feeding radiation electrode and the non-power-feeding radiation electrode. Accordingly, the frequency control effect is effectively attained due to the presence of the dielectric bodies.

In embodiments in which the region near the ground-side end and the region including the portion in which voltage of the resonant frequency in the high-order mode is zero potential and the region in the vicinity of the portion are adjacent to each other with a gap therebetween, and a dielectric body is provided in the gap between the regions, the permittivity control effect described above can be further effectively attained.

In embodiments where each of the dielectric bodies is provided on a certain portion of a corresponding one of the power-feeding radiation electrode and the non-power-feeding radiation electrode, and permittivity of the dielectric body provided on the power-feeding radiation electrode is different from permittivity of the dielectric body provided on the non-power-feeding radiation electrode, the resonant frequencies are individually controlled. Therefore, the resonant frequencies of the power-feeding radiation electrode and the non-power-feeding radiation electrode can be easily controlled. Specifically, in a portable telephone, for example, since various electronic components such as a camera, a speaker, and a scotch connector are provided near an antenna, these components affect the resonant frequencies of the power-feeding radiation electrode and the non-power-feeding radiation electrode. In particular, if the electronic components are provided near the power-feeding radiation electrode or the non-power-feeding radiation electrode and the same dielectric bodies are provided on the power-feeding radiation electrode and the non-power-feeding radiation electrode, only the resonant frequency of one of the electrodes near the electronic component may be drastically lowered due to a corresponding one of the dielectric bodies. In this case, the resonant frequency can be appropriately controlled by reducing the permittivity of the dielectric body on the electrode provided near the electronic components.

Additionally, in embodiments where each of the dielectric bodies is formed of a dielectric sheet, a dielectric block, or dielectric paste, which is in a paste state at a temperature higher than normal temperature and becomes solidified at approximately 160° C., the resonant frequencies can be easily controlled and the antenna can be easily manufactured. Note that the normal temperature can correspond to approximately 25° C. In particular, when the dielectric bodies are formed of the dielectric paste which is in a paste state at a temperature higher than the normal temperature and becomes solidified at approximately 160° C., the dielectric bodies can be provided in very narrow gaps because the dielectric bodies are in paste state at the temperature higher than the normal temperature. Furthermore, the dielectric bodies can be formed in desired shapes, and after the arrangement thereof, a state of the arrangement can be set by heating the dielectric paste to approximately 160° C. so that the dielectric paste is subjected to heat hardening and curing. Accordingly, the dielectric paste is easily handled.

Additionally, each of the electric bodies can be formed of resin having a relative permittivity of 6 or more, and each of the dielectric bodies can include a floating electrode on one side thereof, and one of the dielectric bodies can be sandwiched between the corresponding floating electrode and the power-feeding radiation electrode and the other one of the dielectric bodies may be sandwiched between the corresponding floating electrode and the non-power-feeding radiation electrode. With this configuration, the resonant frequencies can be more easily controlled. Note that a floating electrode has an electrically floated potential (and is not electrically connected to any other portions such as the ground).

The characteristic configuration of the claimed invention allows for miniaturizing an antenna and setting a desired resonant frequency used for antenna operation while reducing or preventing deterioration of radiation efficiency and increase of conductive loss. Accordingly, an antenna suitable for wireless communication apparatuses such as portable telephones can be attained.

Although a limited number of embodiments is described herein, one of ordinary skill in the art will readily recognize that there could be variations to any of these embodiments and those variations would be within the scope of the appended claims. Thus, it will be apparent to those skilled in the art that various changes and modifications can be made to the antenna described herein without departing from the scope of the appended claims and their equivalents.

What is claimed is:

1. An antenna, comprising:

a power-feeding radiation electrode having a power feeding end and an open end, said power-feeding electrode configured to perform antenna operation in a basic mode in which resonant operation is performed in a basic frequency and antenna operation in a high-order mode in which resonant operation is performed in a frequency higher than the basic frequency;

a non-power-feeding radiation electrode electromagnetically connected to the power-feeding radiation electrode, said non-power-feeding radiation electrode having one terminal serving as a ground-side end and another terminal serving as an open end;

a bendable, flexible substrate on which is provided the power feeding radiation electrode and the non-power-feeding electrode with a gap therebetween; and a dielectric body having permittivity higher than that of the bendable, flexible substrate selectively provided on a front surface or a back surface of the power-feeding radiation electrode in a region near the power-feeding end and a region including a portion in which voltage of a resonant frequency in the high-order mode is zero potential and a region in the vicinity of that portion, wherein the power-feeding radiation electrode includes a loop path configured such that the power-feeding radiation electrode first extends in a direction away from the power-feeding end and the open end is bent toward the power-feeding end.

2. The antenna according to claim 1, further comprising:

a dielectric body having permittivity higher than that of the bendable, flexible substrate provided on a front surface or a back surface of the non-power-feeding radiation electrode in a region near the power-feeding end and a region including a portion in which voltage of a resonant frequency in the high-order mode is zero potential and a region in the vicinity of that portion, wherein the non-power-feeding radiation electrode includes a loop path configured such that the non-power-feeding radiation electrode first extends in a direction away from the ground-side end and the open end non-power-feeding radiation electrode is bent toward the ground-side end.

3. The antenna according to claim 1, wherein the non-power-feeding radiation electrode resonates in a frequency in the vicinity of at least one of a resonant frequency in a basic mode and a resonant frequency in a high-order mode so as to perform multi resonance with the power-feeding radiation electrode.

4. The antenna according to claim 1, wherein a dielectric body having permittivity higher than that of the bendable, flexible substrate is provided in the gap between the power-feeding radiation electrode and the non-power-feeding radiation electrode.

5. The antenna according to claim 1, wherein the antenna is supported by or mounted on a circuit substrate and is located near a ground region of the circuit substrate with a gap therebetween, and a dielectric body having permittivity higher than the bendable, flexible substrate is provided on a region on a front surface or a back surface of at least one of the power-feeding radiation electrode and the non-power-feeding radiation electrode so as to be located at a region farthest from the ground region of the circuit substrate.

6. The antenna according to claim 2, wherein through holes are formed in the bendable, flexible substrate at portions where the dielectric bodies are to be provided, and then, the dielectric bodies are provided in the through holes.

7. The antenna according to claim 2, wherein the dielectric bodies are on front surfaces or back surfaces of the corresponding power-feeding radiation electrode and the corresponding non-power-feeding radiation electrode.

8. The antenna according to claim 1, wherein the region near the power-feeding end and the region including the portion in which voltage of the resonant frequency in the high-order mode is zero potential and the region in the vicinity of that portion are adjacent to each other with a gap therebetween, and a dielectric body is provided in the gap between these regions.

9. The antenna according to claim 1, wherein the region near the ground-side end and the region including the portion in which voltage of the resonant frequency in the high-order mode is zero potential and the region in the vicinity of that portion are adjacent to each other with a gap therebetween, and a dielectric body is provided in the gap between these regions.

10. The antenna according to claim 2, wherein each of the dielectric bodies is provided on a certain portion of a corresponding one of the power-feeding radiation electrode and the non-power-feeding radiation electrode, and permittivity of the dielectric body provided on the power-feeding radiation electrode is different from permittivity of the dielectric body provided on the non-power-feeding radiation electrode.

11. The antenna according to claim 2, wherein each of the dielectric bodies is formed of a dielectric sheet, a dielectric block, or dielectric paste which is in a paste state over a temperature higher than normal temperature and becomes solidified at approximately 160° C.

12. The antenna according to claim 2, wherein each of the dielectric bodies is formed of resin having a relative permittivity of 6 or more.

13. The antenna according to claim 2, wherein each of the dielectric bodies includes a floating electrode on one side thereof, and one of the dielectric bodies is sandwiched between the corresponding floating electrode and the power-feeding radiation electrode and the other one of the dielectric bodies is sandwiched between the corresponding floating electrode and the non-power-feeding radiation electrode.

14. The antenna according to claim 1, wherein the antenna is fixedly provided along an inner wall portion of a case of a wireless communication apparatus.

15. An antenna comprising:

a power-feeding radiation electrode having a power feeding end and an open end, said power-feeding electrode configured to perform antenna operation in a basic mode in which resonant operation is performed in a basic frequency and antenna operation in a high-order mode in which resonant operation is performed in a frequency higher than the basic frequency;

a non-power-feeding radiation electrode electromagnetically connected to the power-feeding radiation electrode, said non-power-feeding radiation electrode having one terminal serving as a ground-side end and another terminal serving as an open end;

a bendable, flexible substrate on which is provided the power feeding radiation electrode and the non-power-feeding electrode with a gap therebetween; and a dielectric body having permittivity higher than that of the bendable, flexible substrate provided on a front surface or a back surface of the power-feeding radiation electrode in a region near the power-feeding end and a region including a portion in which voltage of a resonant frequency in the high-order mode is zero potential and a region in the vicinity of that portion, wherein the power-feeding radiation electrode includes a loop path configured such that the power-feeding radiation electrode first extends in a direction away from the power-feeding end and the open end is bent toward the power-feeding end, and the power-feeding radiation electrode is on a front surface of the bendable, flexible substrate, and the dielectric body is directly on a front surface of the power-feeding radiation electrode.

16. The antenna according to claim 15, further comprising:

a dielectric body having permittivity higher than that of the bendable, flexible substrate provided on a front surface or a back surface of the non-power-feeding radiation electrode in a region near the power-feeding end and a region including a portion in which voltage of a resonant frequency in the high-order mode is zero potential and a region in the vicinity of that portion, wherein the non-power-feeding radiation electrode includes a loop path configured such that the non-power-feeding radiation electrode first extends in a direction away from the ground-side end and the open end non-power-feeding radiation electrode is bent toward the ground-side end.

17. The antenna according to claim 16, wherein the non-power-feeding radiation electrode is on a front surface of the bendable, flexible substrate, and each of the dielectric bodies is directly on a front surface of a corresponding one of the power-feeding radiation electrode and the non-power-feeding radiation electrode.

* * * * *